US005081896A

United States Patent [19]

Hiyoshi et al.

[11] Patent Number: 5,081,896

[45] Date of Patent: Jan. 21, 1992

[54] MUSICAL TONE GENERATING APPARATUS

[75] Inventors: Teruo Hiyoshi; Hideo Suzuki; Eiichiro Aoki; Akira Nakada; Shinji Kumano; Kunihiko Watanabe; Masao Sakama, all of Hamamatsu, Japan

[73] Assignee: Yamaha Corporation, Hamamatsu, Japan

[21] Appl. No.: 492,303

[22] Filed: Mar. 7, 1990

Related U.S. Application Data

[63] Continuation of Ser. No. 117,683, Nov. 5, 1987, abandoned.

[30] Foreign Application Priority Data

| | | | |
|---|---|---|---|
| Nov. 6, 1986 | [JP] | Japan | 61-264172 |
| Nov. 18, 1986 | [JP] | Japan | 61-274346 |
| Nov. 18, 1986 | [JP] | Japan | 61-274347 |
| Nov. 18, 1986 | [JP] | Japan | 61-274348 |

[51] Int. Cl.[5] ..... G10H 15/00

[52] U.S. Cl. ..... 84/600; 84/626; 84/639; 84/644; 250/221

[58] Field of Search ..... 84/615, 622, 626, 639, 84/640, 644, 670, 678, 687, 692, 718, 723, 724, 735, 742, 743, 600; 128/391, 736; 250/221, 222.1; 356/27, 372, 384, 385; 340/384 E, 384 R

[56] References Cited

U.S. PATENT DOCUMENTS

| | | | |
|---|---|---|---|
| 2,299,798 | 10/1942 | Colsou et al. | 250/221 X |
| 3,749,810 | 7/1973 | Dow | 84/1.17 X |
| 3,764,813 | 10/1973 | Clement et al. | 250/221 |
| 3,795,546 | 11/1973 | Honeggar | 84/1.01 |
| 3,805,061 | 4/1974 | De Missimy et al. | 250/221 X |
| 3,865,001 | 2/1975 | Hershey | 84/1.03 |
| 3,922,944 | 12/1975 | Kurosaki et al. | 84/1.01 |
| 4,058,977 | 6/1977 | Ryeczek | 84/1.18 X |
| 4,121,488 | 10/1978 | Akiyama | 84/DIG. 7 |
| 4,267,443 | 5/1981 | Carroll et al. | 250/221 |
| 4,429,607 | 2/1984 | Meno | 84/1.24 X |
| 4,450,843 | 5/1984 | Barney et al. | 128/736 X |
| 4,627,324 | 12/1986 | Zwosta | 84/1.01 |
| 4,688,090 | 8/1987 | Veitch | 84/1.18 X |
| 4,763,112 | 8/1988 | Hsieh | 128/736 X |
| 4,776,253 | 10/1988 | Downs | 446/242 X |
| 4,819,860 | 4/1989 | Hargrove et al. | 128/736 X |
| 4,968,877 | 11/1990 | McAvinney et al. | 250/221 |
| 5,017,770 | 5/1991 | Sigalov | 84/639 X |

FOREIGN PATENT DOCUMENTS

| | | | |
|---|---|---|---|
| 2401322 | 7/1975 | Fed. Rep. of Germany | 356/27 |
| 3436703 | 4/1986 | Fed. Rep. of Germany | 84/1.1 |
| 2206030 | 5/1974 | France . | |
| 2502823 | 11/1982 | France . | |
| 2547093 | 12/1984 | France | 84/1.18 |
| 60-33004 | 2/1985 | Japan | 356/372 |
| 87-2168 | 4/1987 | World Int. Prop. O. | 84/1.03 |

*Primary Examiner*—A. T. Grimley
*Assistant Examiner*—Mathew S. Smith
*Attorney, Agent, or Firm*—Spensley Horn Jubas & Lubitz

[57] ABSTRACT

The musical tone generating apparatus converts a movement of a man into a musical tone. Such movement of the man includes a walking or running movement, a jumping movement, a rubbing movement and a beating movement, a turning movement and the like. More specifically, a tone pitch, a tone color, a tone volume or other parameters of the musical tone to be generated is controlled based on a value of a moving speed, a value of a jumping height or a value of frictional heat produced by the rubbing movement of player's hands.

21 Claims, 6 Drawing Sheets

MUSICAL TONE GENERATING APPARATUS

This is a continuation of copending application Ser. No. 117,683 filed on Nov. 5, 1987 now abandoned.

BACKGROUND OF THE INVENTION

1. Field of the Invention

The present invention generally relates to a musical tone generating apparatus, and more particularly to a musical tone generating apparatus which generates a musical tone signal based on a movement of a player such as a movement of a holding, a touching, a beating (or clapping hands), a depressing, a pulling, or a lifting up or down.

2. Prior Art

Conventionally, a musical tone is generated by playing the piano, the violin, the bass drum and the like. Or, the musical tone is accompanied with a voice generated from the vocal chords of the player who sings. Meanwhile, the conventional musical tone generating apparatus controls tone characteristics, such as a tone color, a tone pitch and a tone volume of the musical tone in response to the playing of an electronic musical instrument, for example. However, the conventional musical tone generating apparatus cannot convert the movement of the player into the musical tone.

SUMMARY OF THE INVENTION

It is therefore a primary object of the invention to provide a musical tone generating apparatus which converts the movement of the player into the musical tone.

In a first aspect of the invention, there is provided a musical tone generating apparatus comprising: (a) detecting means for detecting a movement of a moving man; and (b) means for generating a musical tone signal corresponding to a detecting result of the detecting means, the musical tone signal representing a tone pitch, a tone volume or a tone color of a musical tone to be generated.

In a second aspect of the invention, there is provided a musical tone generating apparatus comprising: (a) speed detecting means for detecting a moving speed of a man; and (b) means for generating a musical tone signal corresponding to a detecting result of the speed detecting means, the musical tone signal representing a tone pitch, a tone volume or a tone color of a musical tone to be generated.

In a third aspect of the invention, there is provided a musical tone generating apparatus comprising: (a) position detecting means for detecting a position of a moving man; and (b) means for generating a musical tone signal corresponding to a detecting result of the position detecting means, the musical tone signal representing a tone pitch, a tone volume or a tone color of a musical tone to be generated.

In a fourth aspect of the invention, there is provided a musical tone control apparatus comprising: (a) detecting means for detecting a direction to which a predetermined portion of a man turns; and (b) means for generating musical tone control data which control a musical tone in response to a detecting result of the detecting means.

In a fifth aspect of the invention, there is provided a musical tone control apparatus comprising: (a) detecting means for detecting a direction of a light emitted from light emitting means mounted at a predetermined portion of a man; and (b) means for generating musical tone control data which control a musical tone in response to a detecting result of the detecting means.

In a sixth aspect of the invention, there is provided a musical tone control apparatus comprising: (a) detecting means for detecting a jumping movement of a man; and (b) means for generating musical tone control data which control a musical tone signal based on a detecting result of the detecting means.

In a seventh aspect of the invention, there is provided a musical tone control apparatus comprising: (a) speed detecting means for detecting a jumping speed of a man; and (b) means for generating musical tone control data which control a musical tone signal based on a detecting result of the detecting means.

In an eighth aspect of the invention, there is provided a musical tone control apparatus comprising; (a) height detecting means for detecting a jumping height of a man; and (b) means for generating musical tone control data which control a musical tone signal based on a detecting result of the detecting means.

In a ninth aspect of the invention, there is provided a musical tone control apparatus comprising: (a) detecting means for detecting heat produced by a movement of a man; and (b) means for generating musical tone control data which control a musical tone signal based on a detecting result of the detecting means.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
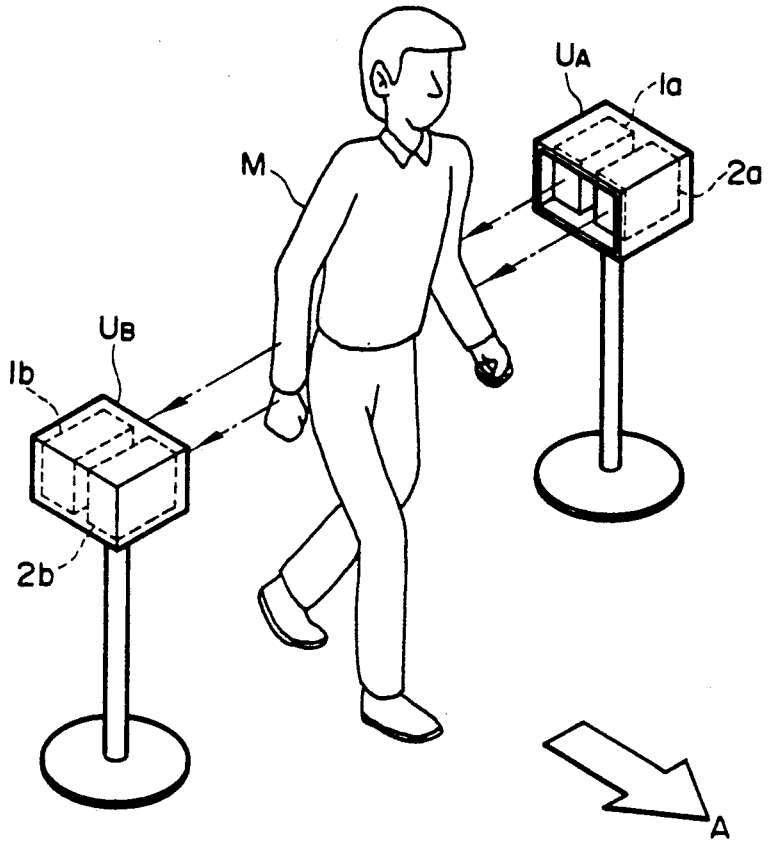
FIG. 1 shows an appearance of a first embodiment of the musical tone generating apparatus according to the present invention.

Referring now to the drawings, wherein like reference characters designate like or corresponding parts throughout the several views description will be given with respect to several embodiments of the present invention in order.

[A] FIRST EMBODIMENT

Figure 2:
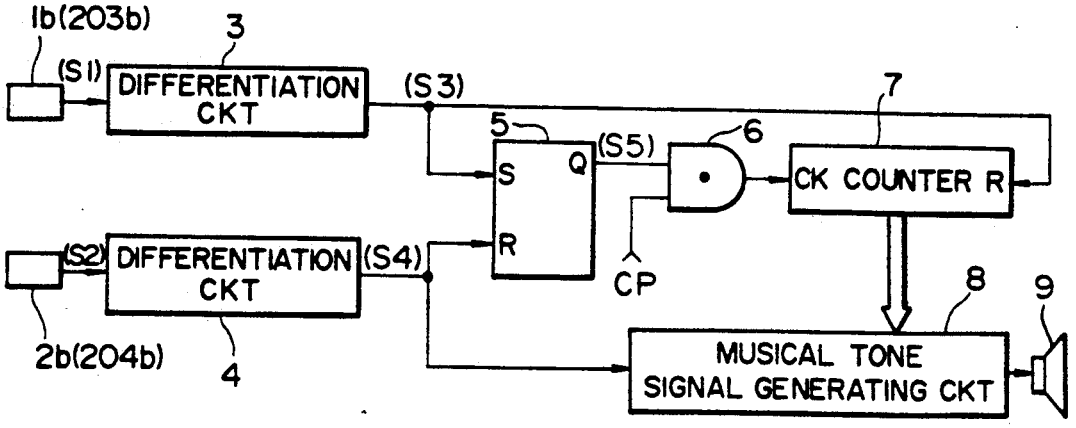
FIG. 2 is a block diagram showing the circuit construction of the first embodiment shown in FIG. 1 and a fourth embodiment shown in FIG. 7.

FIG. 1 shows an appearance of a first embodiment of the present invention, and FIG. 2 is a block diagram showing a circuit constitution of the first embodiment. In FIG. 1, 1*a* and 2*a* designate light emitting elements, 1*b* and 2*b* designate light receiving elements for respectively receiving lights emitted from the light emitting elements 1*a* and 2*a*. The light emitting elements 1*a* and 2*a* are stored in a unit $U_A$, and the light receiving elements 1*b* and 2*b* are stored in a unit $U_B$ The light emitting elements 1*a* and 2*a* are arranged opposite to the light receiving elements 1*b* and 2*b* so that the lights emitted from the elements 1*a* and 2*a* can be received by the elements 1*b* and 2*b* respectively, and these elements 1*a*, 2*a*, 1*b* and 2*b* are all arranged at the same height identical to a height of a human waist. More specifically, the height where these elements 1*a*, 2*a*, 1*b* and 2*b* are arranged is approximately equal to 80 cm height from the floor. When a man M passes through a path between the light emitting elements 1*a*, 2*a* and the light receiving elements 1*b*, 2*b* in a direction A, the light emitted from the light emitting element 1*a* is first shut out by the man M, and then, the light emitted from the light emitting element 2*a* is shut out by the man M. When the light emitted from the light emitting element 1*a* is shut out, an output level of the light receiving element 1*b* turns up to a high (H) level. Similarly, when the light emitted from the light emitting element 2*a* is shut out, an output level of the light receiving element 2*b* turns up to the "H" level.

Next, in FIG. 2, a differentiation circuit 3 outputs a pulse signal to a set input terminal S of a flip-flop 5 to thereby set the flip-flop 5 at a leading edge timing of the output signal of the light receiving element 1*b*, and another differentiation circuit 4 outputs another pulse signal to a reset input terminal R of the flip-flop 5 to thereby reset the flip-flop 5 at a leading edge timing of the output signal of the light receiving element 2*b*. More specifically, this flip-flop 5 is set when the man M shuts out the light emitted from the light emitting element 1*a*, and this flip-flop 5 is reset when the man M shuts out the light emitted from the light emitting element 2*a*. As a result, a pulse width of an output signal outputted from an output terminal Q of the flip-flop 5 corresponds to a moving speed of the man M who moves in the direction A. Next, an AND gate 6 is subjected to an open state while the output level of the flip-flop 5 is at the "H" level, whereby a clock pulse CP is supplied to a clock input terminal CK of a counter 7 via the AND gate 6. Therefore, the moving speed of the man M can be represented by a count value of the counter 7 at a trailing edge timing of the output signal of the flip-flop 5 (i.e., at a timing when the differentiation circuit 4 outputs the pulse signal therefrom). Count data representative of such count value of the counter 7 are supplied to and read by a musical tone signal generating circuit 8 at the timing when the differentiation circuit 4 outputs the pulse signal. Hence, the musical tone signal generating circuit 8 generates a musical tone signal having a tone pitch corresponding to the above count value. This musical tone signal is supplied to a speaker 9 wherein a musical tone having a tone pitch corresponding to the moving speed of the man M is generated.

The above-mentioned first embodiment generates the musical tone when the man M moves in a predetermined one direction (i.e., the direction A). However, it is possible to generate the musical tones respectively when the man M moves forward and backward between the units $U_A$ and $U_B$. On the other hand, the first embodiment varies the tone pitch of the musical tone in response to the moving speed of the man M. However, it is possible to vary a tone volume or a tone color in response to the moving speed of the man M.

[B] SECOND EMBODIMENT

Figure 3:
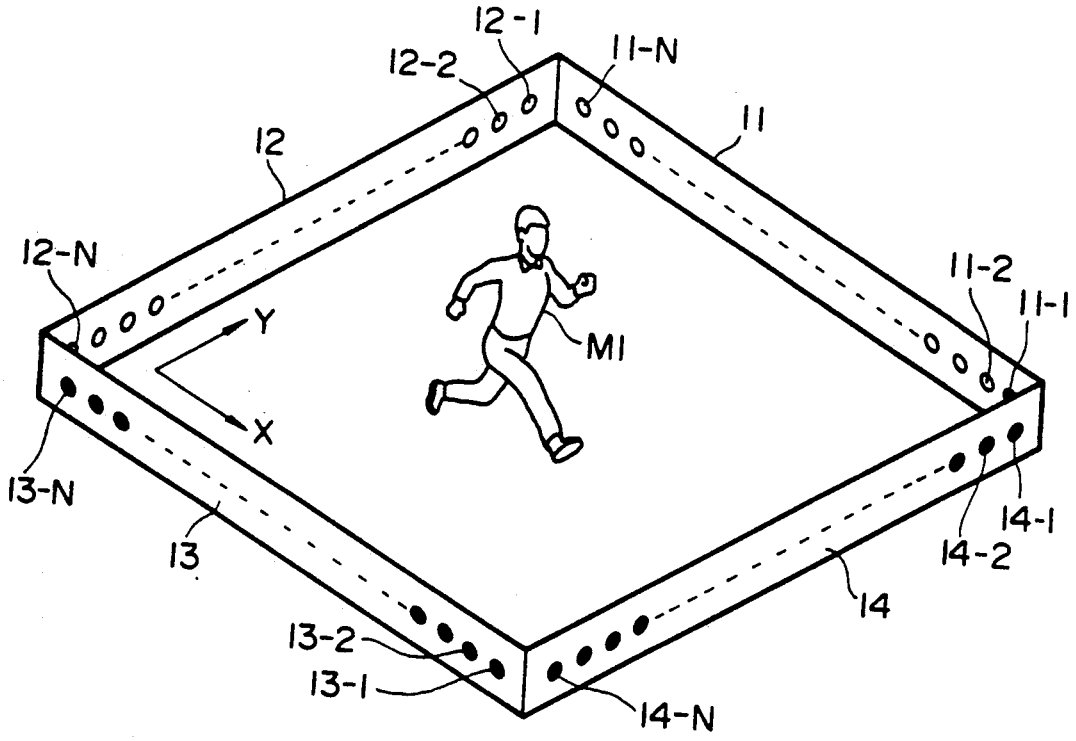
FIG. 3 shows a main portion of a second embodiment.
Figure 4:
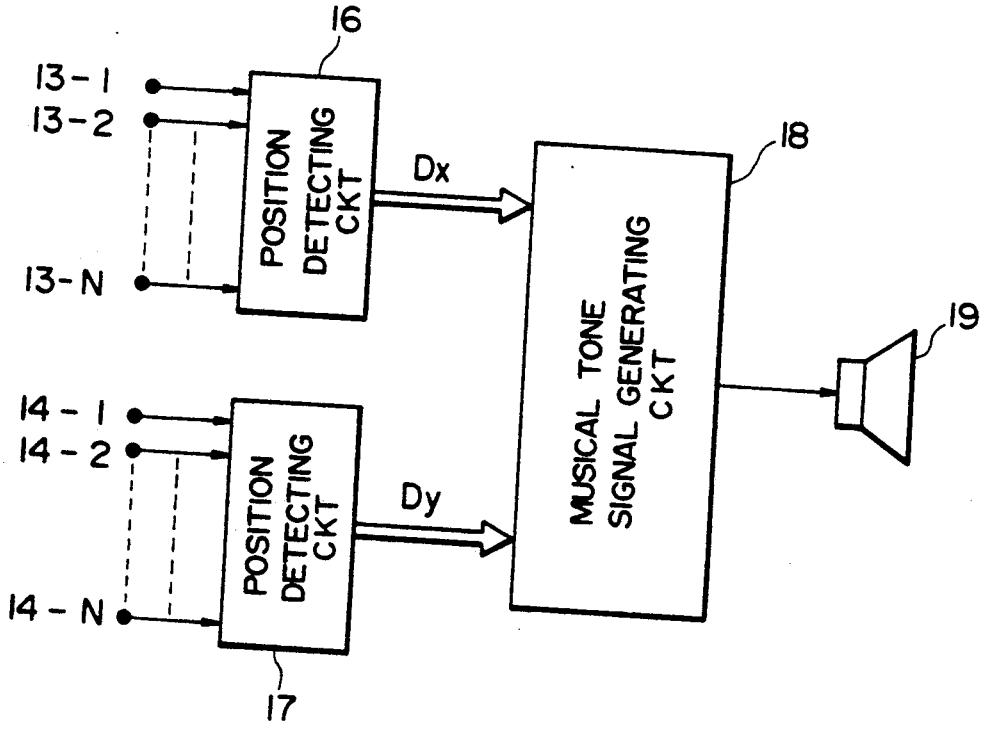
FIG. 4 is a block diagram showing the second embodiment.

Next, description will be given with respect to a second embodiment in conjunction with FIGS. 3 and 4. As shown in FIG. 3, a certain square area is surrounded by four walls 11 to 14. Light emitting elements 11-1 to 11-N (where N denotes an integral number) are arranged on the wall 11 by certain intervals, and other light emitting elements 12-1 to 12-N are arranged on the wall 12 by certain intervals. On the other hand, light receiving elements 13-1 to 13-N are arranged on the wall 13 by certain intervals such that the lights emitted from the elements 11-1 to 11-N are respectively received by the elements 13-1 to 13-N, and light receiving elements 14-1 to 14-N are arranged on the wall 14 by certain intervals such that the lights emitted from the elements 12-1 to 12-N are respectively received by the elements 14-1 to 14-N. All of above-mentioned elements are arranged on the walls 11 to 14 approximately at the same 80 cm height from the floor. As shown in FIG. 4, output signals of the light receiving elements 13-1 to 13-N are supplied to a position detecting circuit 16, and output signals of the light receiving elements 14-1 to 14-N are supplied to another position detecting shown in FIG. 1, the light receiving elements 13-1 to 13-N output "H" level signals respectively when the lights emitted from the light emitting elements 11-1 to 11-N are shut out. Similarly, the light receiving elements 14-1 to 14-N output "H" level signals respectively when the lights emitted from the light emitting elements 12-1 to 12-N are shut out.

The position detecting circuit 16 detects a position in a direction X (i.e., an X-position) of a man M1 who moves within the square area surrounded by the four walls 11 to 14 based on a position of one light receiving element outputting the "H" level signal among the light receiving elements 13-1 to 13-N, and the position detecting circuit 16 outputs X-position data Dx representative of the detected X-position of the man M1 to a musical tone signal generating circuit 18. Similarly, the position detecting circuit 17 detects a position in a direction Y (i.e., a Y-direction) of the man M1 based on a position of one light receiving element outputting the "H" level signal among the light receiving elements 14-1 to 14-N, and the position detecting circuit 17 outputs Y-position data Dy representative of the detected Y-position of the man M1 to the musical tone signal generating circuit 18. The musical tone signal generating circuit 18 generates a musical tone signal having a tone pitch corresponding to the value of the X-position data Dx, and the amplitude level of such musical tone signal is controlled by the value of the Y-direction data Dy. Such musical tone signal is supplied to a speaker 19. Thus, the speaker 19 generates a musical tone having a tone pitch corresponding to the X-position of the man M1 and also having a tone volume corresponding to the Y-direction of the man M1.

Incidentally, the above-mentioned second embodiment determines the tone pitch of the musical tone based on the X-position data Dx and also determines the tone volume of the musical tone based on the Y-direction data Dy. On the contrary, it is possible to determine the tone volume of the musical tone based on the X-position data Dx and also determine the tone pitch of the musical tone based on the Y-direction data Dy. In addition, it is possible to determine a tone color of the musical tone based on one of the data Dx and Dy. Furthermore, it is possible to control the tone pitch (or the tone color or the tone volume) of the musical tone based on a combination of the data Dx and Dy.

[C] THIRD EMBODIMENT

Figure 5:
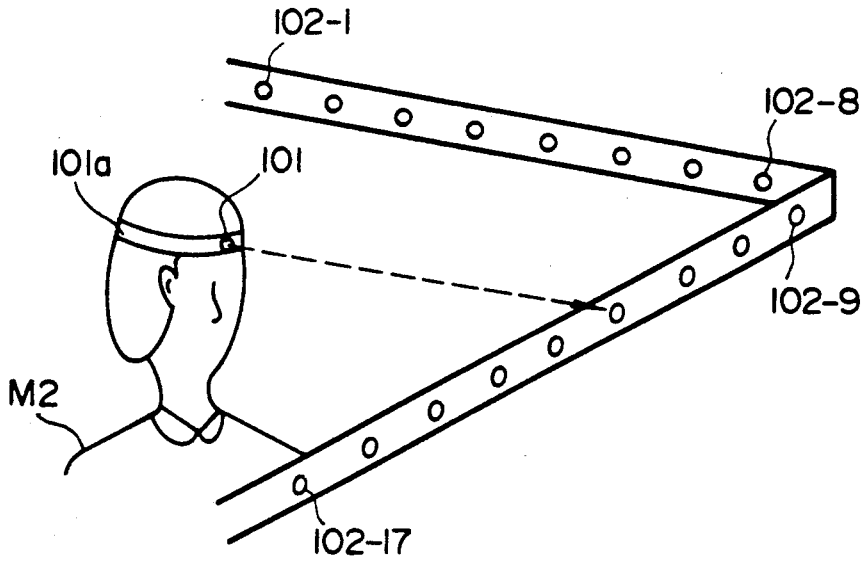
FIG. 5 shows a main portion of a third embodiment.
Figure 6:
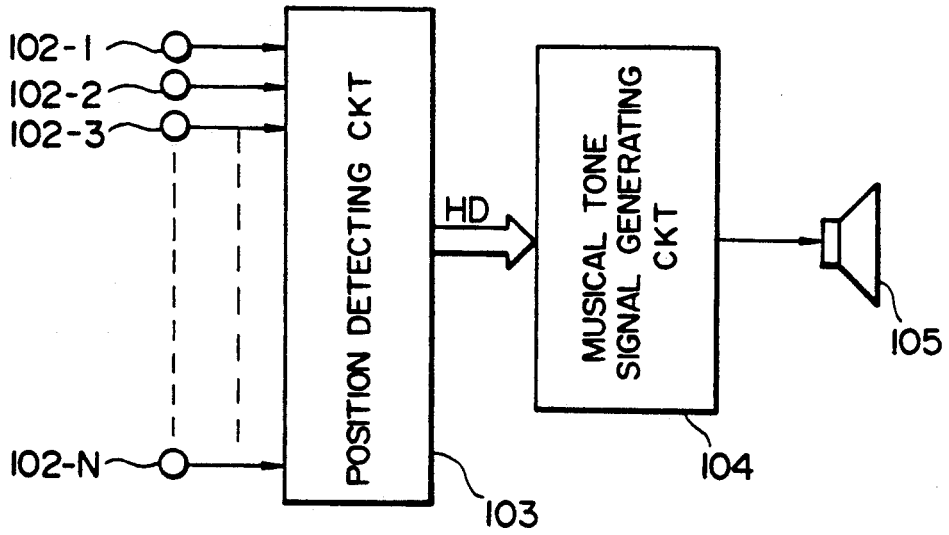
FIG. 6 is a block diagram showing the third embodiment.

Next, description will be given with respect to a third embodiment in conjunction with FIGS. 5 and 6. In FIG. 5, an infrared (ray) oscillator 101 is fixed at a brow of a man M2 by use of a band 101*a*, and infrared (ray) sensors 102-1 to 02-N (where N denotes an integral number) are attached and disposed on surrounding walls of a room at the same height approximately identical to a height of the brow of the man M2 by predetermined intervals. Each infrared sensor outputs the "H" level voltage when infrared rays radiated from the infrared oscillator 101 are received by the infrared sensor, and each infrared sensor outputs the "L" (low) level voltage when the infrared rays are not received by the infrared sensor. Such output voltages of the infrared sensors 102-1 to 102-N are respectively supplied to a position detecting circuit 103 shown in FIG. 6. The position detecting circuit 103 detects a direction to which the infrared oscillator 101 turns (i.e., a direction to which a face of the man M2 turns) based on a position of the infrared sensor outputting the "H" level voltage within the infrared sensors 102-1 to 102-N. Hence, the position detecting circuit 103 outputs data HD representative of the detected direction to a musical tone signal generating circuit 104 as musical tone control data. The musical tone signal generating circuit 104 generates a musical tone signal having a tone pitch corresponding to the value of the data HD. Such musical tone signal is supplied to a speaker 105. Thus, the speaker 105 generates a musical tone having a tone pitch corresponding to the direction to which the man M2 turns based on the musical tone signal.

As described above, the third embodiment generates the musical tone corresponding to the direction to which the man M2 turns. In other words, the third embodiment can convert a "turning" movement of the man M2 into the musical tone.

Incidentally, the third embodiment provides the infrared oscillator 101 mounted on the brow of the man M2 so as to detect the direction to which the man M2 turns. Instead, it is possible to mount the infrared oscillator 101 on a breast or a trunk of the man M2 so as to detect a direction to which a body of the man M2 turns. In this case, the infrared sensors 102-1 to 102-N must be fixed at positions having the same height approximately identical to a height of the breast or the trunk of the man M2.

In addition, the third embodiment controls the tone pitch of the musical tone based on the data HD. Instead, it is possible to control a tone length, the tone color or the tone volume of the musical tone. Furthermore, it is possible to select one of a plurality of preset states of the tone colors based on the data HD.

[D] FOURTH EMBODIMENT

Figure 7:
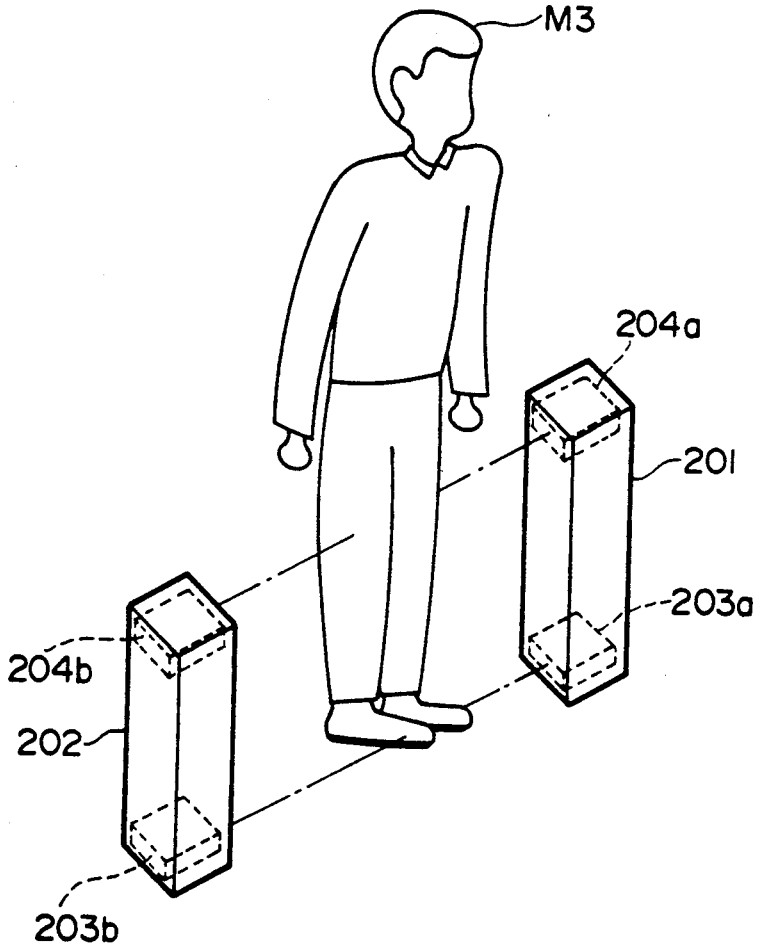
FIG. 7 shows an appearance of the fourth embodiment.
Figure 8:
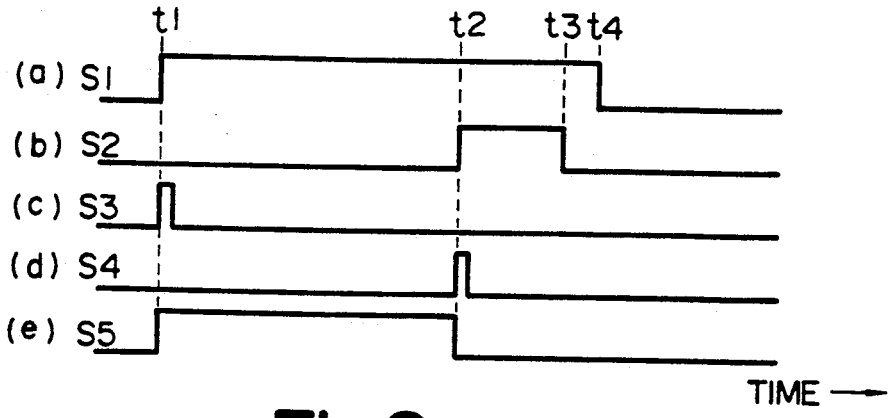
FIGS. 8(*a*) to 8(*e*) show waveforms of signals at several points of the circuit shown in FIG. 2 according to the fourth embodiment.

Next, description will be given with respect to a fourth embodiment in conjunction with FIGS. 7 and 8. FIG. 7 is a perspective view showing a position detecting section of the fourth embodiment. In FIG. 7, stands 201 and 202 are stood vertically to the floor. This stand 201 provides a light emitting element 203*a* (such as a light emitting diode (LED) and the like) at the lowest portion thereof and also provides a light emitting element 204*a* (such as the LED) at the highest portion thereof. On the other hand, the stand 202 provides light receiving elements 203*b* and 204*b* (such as photodiodes and the like) at the lowest and highest portions thereof respectively. The elements 203*a* and 203*b* are placed at the same height position so that an optical axis of the element 203*a* is set identical to that of the element 203*b*. Similarly, the elements 204*a* and 204*b* are placed at the same height position so that an optical axis of the element 204*a* is set identical to that of the element 204*b*. Further, a predetermined distance is formed between the stands 201 and 202.

Next, description will be given with respect to the operation of the fourth embodiment. The electric circuit construction of the fourth embodiment is identical to that of the first embodiment shown in FIG. 2, hence, description thereof will be given with respect to different points between the first and fourth embodiments.

When a man M3 stands at a position between the stands 201 and 202, lights respectively emitted from the light emitting elements 203*a* and 204*a* are shut out by the man M3. Hence, levels of output signals S1 and S2 (shown in FIGS. 8(*a*) and 8(*b*); in FIG. 8, a horizontal axis represents the time and the vertical axis represents the signal level) of the light receiving elements 204*a* and 204*b* turn down to the, "L" levels. Next, when the man M3 jumps up and his feet leap off the floor at a time t1, the light emitted from the light emitting element 203*a* is radiated to the light receiving element 203*b* wherein the level of the output signal S1 thereof turns up to the "H" level. At a next time t2 when a jumping height of the feet of the man M3 exceeds over the height of the light receiving element 204*b*, the light emitted from the light emitting element 204*a* is radiated to the light receiving element 204*b* wherein the level of the output signal S2 thereof turns up to the "H" level. Thereafter, at a time t3 when the jumping height of the feet of the man M3 becomes lower than the height of the light receiving element 204*b*, the light emitted from the light emitting element 204*a* must be shut out by the man M3, whereby the level of the signal S2 turns down to the "L" level. Lastly, at a time t4 when the feet of the man M3 lands at the floor, the light emitted from the light emitting element 203*a* is shut out by the man M3, whereby the level of the signal S1 turns down to the "L" level.

The above-mentioned signals S1 and S2 are supplied to the differentiation circuits 3 and 4 (shown in FIG. 2) wherein the leading edge portions of the signals S1 and S2 are differentiated. The differentiation circuit 3 outputs a pulse signal S3 (shown in FIG. 8(*c*)) at the time t1 when the feet of the man M3 leap off the floor, and another differentiation circuit 4 outputs a pulse signal S4 (shown in FIG. 8(*d*)) at the time t2 when the height of the feet of the man M3 exceeds the height of the light receiving element 204*b*. The flip-flop 5 is set by the leading edge timing t1 of the signal S3 and reset by the leading edge timing t2 of the signal S4. Therefore, a pulse width of a signal S5 (shown in FIG. 8(*e*)) outputted from the output terminal Q of the flip-flop 5 corresponds to a jumping speed of the man M3. Next, the AND gate 6 is subjected to the open state in a high level period of the signal S5, hence, the clock pulse CP is supplied to the clock input terminal CK of the counter 7 in such period. This counter 7 is reset at the leading edge timing t1 of the signal S3 when the feet of the man M3 leaps off the floor, and the counter 7 starts to count up the count value thereof from that time and outputs the count data. The count value of the count data at the trailing edge timing t2 of the signal S5 corresponds to the jumping speed of the man M3. Such count data are supplied to the musical tone signal generating circuit 8 as the musical tone control data. The musical tone signal generating circuit 8 inputs the count data of the counter 7 at the leading edge timing t2 of the signal S4 outputted from the differentiation circuit 4 to thereby output the musical tone signal having the tone pitch corresponding to the count data. This musical tone signal drives the speaker 9 as described before.

[E] FIFTH EMBODIMENT

Figure 9:
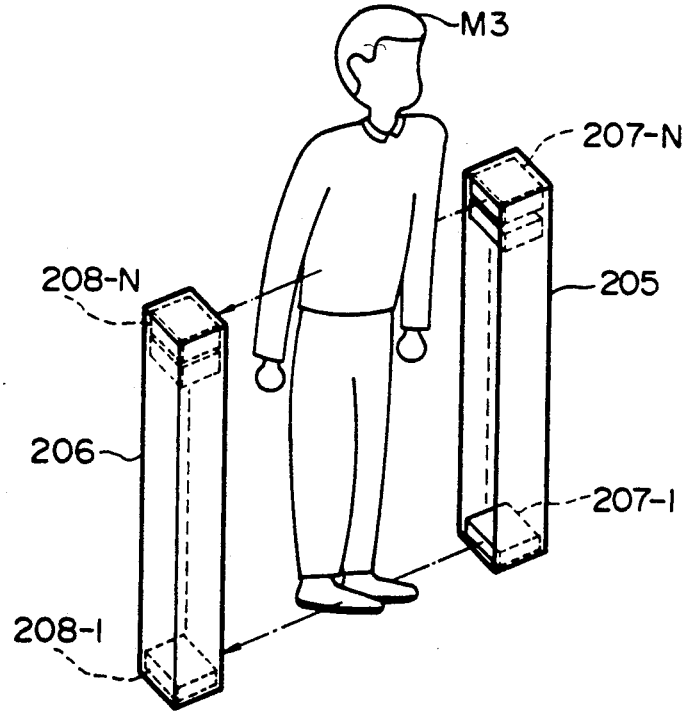
FIG. 9 shows an appearance of a fifth embodiment.

Next, description will be given with respect to a fifth embodiment in conjunction with FIGS. 9 and 10. FIG. 9 is a perspective view showing a position detecting section of the musical tone generating circuit according to the fifth embodiment of the present invention. In FIG. 9, stands 205 and 206 are stood vertically to the floor. The stand 205 provides a light emitting element 207-1 (identical to the light emitting elements 203*a* and 204*a* shown in FIG. 7) at the lowest portion thereof, and light emitting elements 207-2 to 207-N are sequentially arranged above the light emitting element 207-1 by forming a predetermined interval between two adjacent light emitting elements. On the other hand, the stand 206 provides light receiving elements 208-1 to 208-N (identical to the light receiving elements 203*b* and 204*b*) each of which corresponds to each of the light emitting elements 207-1 to 207-N. These light receiving elements 208-1 to 208-N are arranged within the stand 206 such that each of optical axes of the light emitting elements 207-1 to 207-N coincides with each of those of the light receiving elements 208-1 to 208-N.

The overall operation of the fifth embodiment is as follows. When the man M3 stands at a position between the stands 205 and 206, the lights emitted from the light emitting elements 207-1 to 207-N are shut out by the man M3. Hence, all levels of output signals Sa1 to SaN of the light receiving elements 208-1 to 208-N turn to the "L" levels. Next, when the man M3 jumps up and the highest jumping height thereof is approximately equal to or slightly higher than a height of a light receiving element 208-M (where M denotes an integral number, and M is set equal to or smaller than N), the levels of the output signals Sa1 to SaM of the light receiving elements 208-1 to 208-M turn to the "H" levels but other levels of the output signals of the light receiving elements 208-M+1 to 208-N are maintained at the "L" levels.

Figure 10:
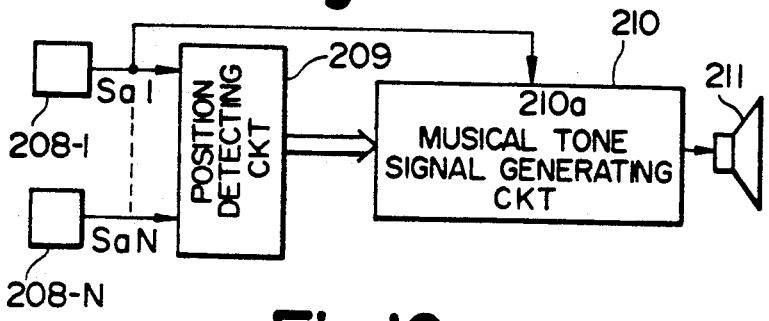
FIG. 10 is a block diagram showing the fifth embodiment.

The above-mentioned signals Sa1 to SaN are supplied to a position detecting circuit 209 shown in FIG. 10. The position detecting circuit 209 checks levels of the signals Sa1 to SaN to thereby generate position data representative of the highest jumping height of the man M3. Such position data are supplied to a musical tone signal generating circuit 210 as the musical tone control data. After the position detecting circuit 209 detects a trailing edge timing of the signal Sa1 (i.e., a timing when the man M3 lands at the floor), the position detecting circuit 209 is reset. The musical tone signal generating circuit 210 inputs the position data outputted from the position detecting circuit 209 at the trailing edge timing of the signal Sa1 inputted into a control terminal 210*a* thereof. In other words, the musical tone signal generating circuit 209 inputs the position data when the man M3 lands at the floor after the man M3 jumps up. Hence, this musical tone signal generating circuit 209 generates a musical tone signal having a tone pitch corresponding to the inputted position data. This musical tone signal drives a speaker 211 as described before.

As described heretofore, both of the fourth and fifth embodiments controls the musical tone based on the "jumping" movement of the man M3. More specifically, the fourth embodiment controls the tone pitch of the musical tone based on the jumping speed of the man M3, while the fifth embodiment controls the tone pitch of the musical tone based on the jumping height of the man M3.

Incidentally, the fourth embodiment controls the tone pitch of the musical tone based on the count data of the counter 7, while the fifth embodiment controls the tone pitch of the musical tone based on the position data of the position detecting circuit 209. Instead, it is possible to control the tone length, the tone color or the tone volume of the musical tone based on the above count data or the position data. In addition, it is also possible to modify the fourth and fifth embodiments such that one of plural preset states of tone colors is selected based on the above count data or the position data.

[F] SIXTH EMBODIMENT

Figure 11A:
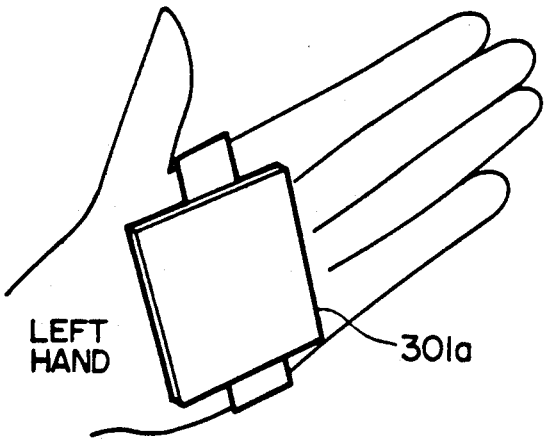
FIGS. 11A and 11B show thermal detectors mounted on player's hands according to a sixth embodiment.
Figure 11B:
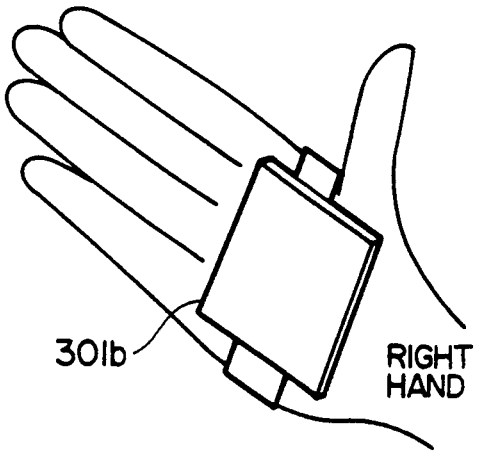
Figure 12:
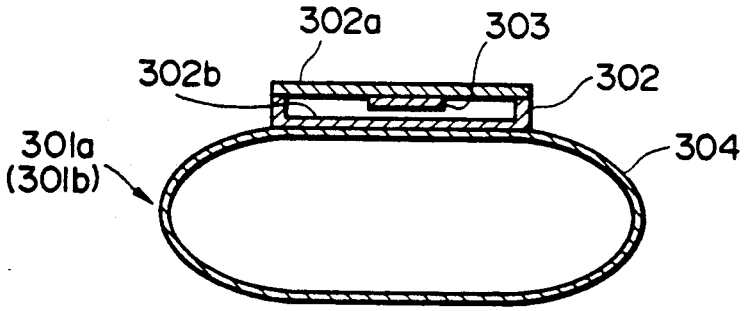
FIG. 12 is a sectional view showing the thermal detector shown in FIGS. 11A and 11B.

Next, description will be given with respect to a sixth embodiment. FIGS. 11A and 11B show player's left and right hands the palms of which are mounted by thermal detectors 301*a* and 301*b* respectively. Each of these thermal detectors 301*a* and 301*b* is constructed by an outside frame 302, a temperature sensor 303 and a belt 304 as shown by a sectional view in FIG. 12. The outside frame 302 shapes like a square plate and has a hollow construction. In addition, an upper plate 302*a* of the outside frame 302 is formed by use of a metal having a relatively large thermal conductivity and the like, and a lower side surface thereof is mounted with the temperature sensor 303 constituted by a semiconductor and the like. In addition, a lower side surface of a bottom plate 302*b* of the outside frame 302 is fixed at a certain portion of the belt 304. Hence, each thermal detector is fixed at the palm of the player's hand by use of the belt 304.

Figure 13:
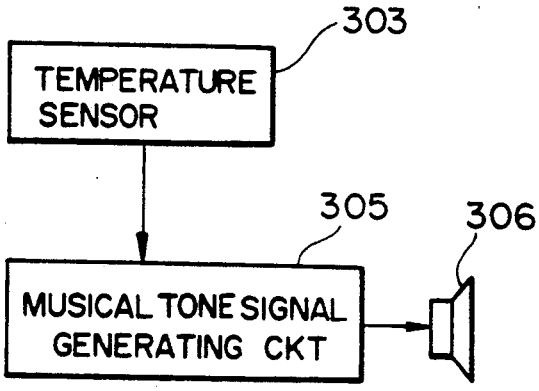
FIG. 13 is a block diagram showing the sixth embodiment.

Next, the overall operation of the sixth embodiment is as follows. When an upper side surface of the upper plate 302*a* of the thermal detector 301*a* (or 301*b*) is rubbed by a certain object, heat must be produced by friction between the thermal detector 301*a* (or 301*b*) and the certain object. Such produced heat is transmitted to the temperature sensor 303 (shown in FIG. 13) wherein such produced heat is converted into a voltage and such voltage is supplied to a musical tone signal generating circuit 305 as the musical tone control data. Hence, the musical tone signal generating circuit 305 generates a musical tone signal having a tone pitch corresponding to an output level of the temperature sensor 303. Such musical tone signal is supplied to a speaker 306. Thus, the speaker 306 generates a musical tone having a tone pitch corresponding to a value of heat produced by the friction between the upper side plate 302*a* of the thermal detector 301*a* (or 301*b*) and the certain object. For example, the sixth embodiment can generate the musical tone having the tone pitch which becomes higher as the value of heat produced by the above friction becomes larger.

Incidentally, the above-mentioned sixth embodiment controls the tone pitch of the musical tone based on a frictional heat. Instead, it is possible to control the tone color, the tone volume, the tone length or a tempo based on the frictional heat. In addition, it is also possible to select one preset state from plural preset states of tone colors in response to the frictional heat. Further, it is possible to modify the sixth embodiment such that the output level of the temperature sensor 303 is converted into digital data representative of the musical tone control data in an analog-to-digital converter and such digital data are supplied to the musical tone signal generating circuit 305. Furthermore, the sixth embodiment detects the heat produced by a rubbing movement of the player's hands. However, it is possible to detect heat produced by a beating movement of the player.

The above is the description of preferred embodiments of the present invention. According to the present invention, it is possible to obtain specific characteristics in a rhythm gymnastics field and other fields.

Lastly, this invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. A musical tone generating apparatus for generating a musical tone corresponding to a detected speed of a person moving on a generally horizontal surface, comprising:

(a) first means comprising a first pair of a first light emitting element and a first light receiving element and a second pair of a second light emitting element and a second light receiving element, each of the first and second light emitting elements and each of the first and second light receiving elements being arranged such that a light emitted from each light emitting element can be received by each light receiving element thereby defining first and second light paths, wherein the first and second light paths are substantially parallel to the surface, an output level of each light receiving element being varied when the light emitted from each light emitting element is shut out by the person, a predetermined interval being formed between said first and second light emitting elements and between the first and second light receiving elements as well, whereby output levels of the first and second light receiving elements are sequentially varied when the person passes through a path formed between the first and second light emitting elements and the first and second light receiving elements;

(b) second means for generating a detection signal representing the speed of the person based on the predetermined interval and a period between a first time when the output level of the first light receiving element varies and a second time when the output level of the second light receiving element varies; and (c) means for generating a musical tone signal corresponding to the detection signal, the musical tone signal representing at least one of a tone pitch, a tone volume and a tone color of a musical tone to be generated.

2. A musical tone control apparatus according to claim 1, wherein the first means is freely movable.

3. A musical tone generating apparatus for generating a musical tone corresponding to a detected two dimensional position of a moving person, comprising:

(a) first means for detecting an X-position and a Y-position of the moving person, a combination of the X-position and the Y-position representing the two dimensional position of the moving person within a predetermined area;

(b) second means for generating X-position data representative of the X-position detected by the first means and Y-position data representative of the Y-position detected by the first means; and (c) means for generating a musical tone signal corresponding to the X-position data and the Y-position data, the musical tone signal representing at least one of a tone pitch, a tone volume and a tone color of a musical tone to be generated.

4. A musical tone generating apparatus according to claim 3 wherein said first means comprises (a) first pairs consisting of first to Nth (where N denotes an integral number) light emitting elements and first to Nth light receiving elements which are arranged such that a light emitted from each light emitting element can be received by each light receiving element, certain light receiving element varying an output level thereof when the light emitted from certain light emitting element is shut out by said moving man, whereby said X-direction of said moving man is detected by checking output levels of said light receiving elements; and (b) second pairs consisting of first to Nth light emitting elements and first to Nth light receiving elements which are arranged such that a light emitted from each light emitting element can be received by each light receiving element, said first pairs and said second pairs being arranged such that the light emitted from each light emitting element within said first pairs falls at right angles with another light emitted from each light emitting element within said second pairs, certain light receiving element varying an output level thereof when the light emitted from certain light emitting element is shut out by said moving van, whereby said Y-direction of said moving man is detected by checking output levels of said light receiving elements within said second pairs.

5. A musical tone generating apparatus according to claim 3, wherein the X-position corresponds to a tone pitch and the Y-position corresponds to a tone volume in the musical tone to be generated so that tone pitch and tone volume of the musical tone are respectively varied in response to the variations of X and Y positions.

6. A musical tone control apparatus, comprising:

(a) detecting means for detecting a facing direction to which the head of a person turns, said facing direction being located in a substantially horizontal plane; and (b) means for generating musical tone control data which control a musical tone in response to a detecting result of said detecting means.

7. A musical tone control apparatus according to claim 6, wherein said detecting means comprises:

(a) first means for radiating rays therefrom, said first means being mounted at a predetermined portion of the head of said person at a predetermined height; and (b) second means, comprising a plurality of ray sensors, for receiving said rays, said ray sensors being disposed at said predetermined height with predetermined intervals between adjacent ray sensors, each ray sensor varying an output level thereof when said rays are radiated thereto, wherein said detecting means detects said facing direction to which the head of said person turns by detecting said ray sensor output which varies.

8. A musical tone control apparatus, comprising:

(a) light emitting means for emitting light, said light emitting means being adapted to be mounted on the head of a person;

(b) detecting means for detecting a direction of light emitted from said light emitting means within a substantially horizontal plane; and (c) means for generating musical tone control data which control a musical tone in response to a detecting result of said detecting means.

9. A musical tone control apparatus for generating a musical tone corresponding to a jumping speed of a person, comprising:

(a) first means for detecting a first time when a person jumps up so that a predetermined portion of the person passes over a first height position and a second time when the person jumps up so that the predetermined portion of the person passes over a second height position which is set higher than the first height position;

(b) second means for generating a detection signal representing a period between the first time and the second time; and (c) maens for generating musical tone control data which control a musical tone signal based on the detection signal.

10. A musical tone control apparatus according to claim 9 wherein said first means comprises (a) a first pair of a first light emitting element and a first light receiving element both of which are placed at said first height position such that a light emitted from said first light emitting element is radiated to said first light receiving element being varied when the light emitted from said first light receiving element is shut out by said person; and a second pair of a second light emitting element and a second light receiving element both of which are placed at said second height position such that a light emitted from said second light emitting element is radiated to said second light receiving element, an output level of said second light receiving element being varied when the light emitted from said second light emitting element is shut out by said person, the output level of said second light receiving element being varied at said second time after the output level of said first light receiving element is varied at said first time while said person jumps up and his or her jumping height position becomes higher, said second means detecting the period between said first and second times by checking the output levels of said first and second light receiving elements.

11. A musical tone control apparatus according to claim 9, wherein the first means is freely movable.

12. A musical tone control apparatus, comprising:

(a) height detecting means for detecting a jumping height of a person, said height detecting means comprising plural pairs of light emitting elements and light receiving elements, said pairs being disposed in a vertical height direction; and (b) means for generating musical tone control data which control a musical tone signal based on a detecting result of said detecting means.

13. A musical tone control apparatus according to claim 12, wherein each of said plural pairs of light emitting elements and light receiving elements is disposed in said vertical height direction such that a predetermined interval is formed between two adjacent pairs, light emitted from said light emitting elements being radiated to corresponding light receiving elements respectively, output levels of said light receiving elements being varied when the lights emitted from said light emitting elements are shut out by said person, the output levels of a certain number of said light receiving elements corresponding to said jumping height of said person being varied while said person jumps up at a position between said light emitting elements and said light receiving elements, said musical tone control data generating means generating said musical tone control data in response to said certain number of said light receiving elements.

14. A musical tone control apparatus according to claim 12, wherein the height detecting means is freely movable.

15. A musical tone control apparatus, comprising:

(a) detecting means for detecting external frictional heat produced by a movement of a person; and (b) means for generating musical tone control data which control a musical tone signal based on a detecting result of said detecting means.

16. A musical tone control apparatus according to claim 15 wherein said movement of said person is identified as a rubbing movement of said person.

17. A musical tone control apparatus according to claim 15 wherein said movement of said person is identified as a beating movement of said person.

18. A musical tone control apparatus according to claim 15, wherein the musical tone control data indicative of at least one of a tone pitch, a tone volume and a tempo are varied in response to temperature due to the produced heat.

19. A musical tone generating apparatus, comprising:

(a) freestanding movable detecting means for detecting a movement of a moving person with respect to said detecting means without contacting the person;

(b) means for generating two light beams, the axes of which are disposed substantially in parallel, said means comprising two pairs of light emitting elements and light receiving elements which pairs can be freely and independently moved to thereby alter the length of the light beam paths; and (c) means for generating a musical tone signal corresponding to a detecting result of said detecting means, said musical tone signal representing at least one of a tone pitch, a tone volume and a tone color of a musical tone to be generated.

20. A musical tone control apparatus, comprising:

(a) freestanding movable detecting means for detecting a jumping height of a person, said height detecting means comprising plural pairs of light emitting elements and light receiving elements, said pairs being disposed in a vertical height direction; and (b) means for generating musical tone control data which control a musical tone signal based on a detecting result of said detecting means.

21. A musical tone control apparatus comprising:

(a) speed detecting means comprising plural detecting elements which cooperate to detect at least a vertical component of a jumping velocity of a person; and (b) means for generating musical tone control data which control a musical tone signal based on a detecting result of said detecting means.

* * * * *